US008715403B2

(12) United States Patent
Brouwer et al.

(10) Patent No.: US 8,715,403 B2
(45) Date of Patent: May 6, 2014

(54) MULTI-STAGE PRE-TREATMENT METHOD FOR METAL COMPONENTS HAVING ZINC AND IRON SURFACES

(75) Inventors: Jan-Willem Brouwer, Willich (DE); Frank-Oliver Pilarek, Köln (DE); Jens Krömer, Düesseldorf (DE); William E. Fristad, Rochester, MI (US); Helene Maechel, Ostwald (FR)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/484,848

(22) Filed: May 31, 2012

(65) Prior Publication Data

US 2012/0325110 A1 Dec. 27, 2012

Related U.S. Application Data

(63) Continuation of application No. PCT/EP2010/067448, filed on Nov. 15, 2010.

(30) Foreign Application Priority Data

Dec. 4, 2009 (DE) ..... 10 2009 047 522

(51) Int. Cl.
*C23C 18/34* (2006.01)
*C23C 18/52* (2006.01)

(52) U.S. Cl.
USPC ..... 106/1.22; 106/1.25; 106/1.27

(58) Field of Classification Search
USPC ..... 106/1.22, 1.25, 1.27
See application file for complete search history.

(56) References Cited

U.S. PATENT DOCUMENTS

| | | | | |
|---|---|---|---|---|
| 3,357,854 | A * | 12/1967 | Hays | 106/1.27 |
| 3,515,600 | A * | 6/1970 | Ellis et al. | 148/261 |
| 4,278,477 | A * | 7/1981 | Reinhold | 106/1.27 |
| 5,032,236 | A * | 7/1991 | Saitou et al. | 205/138 |
| 5,318,640 | A * | 6/1994 | Ishii et al. | 148/264 |

(Continued)

FOREIGN PATENT DOCUMENTS

| | | | |
|---|---|---|---|
| AU | 519486 | B2 | 12/1981 |
| DE | 10115244 | A1 | 10/2002 |

(Continued)

OTHER PUBLICATIONS

Machine translation of JP 2006/322048, Nov. 2006.*
Derwent Abstract of DE 10115244, 4 pages; Oct. 2002.*
International Search Report mailed Jan. 24, 2011 for PCT/EP2010/067448. All references cited in the International Search Report are listed herein.

(Continued)

*Primary Examiner* — Helene Klemanski
(74) *Attorney, Agent, or Firm* — Mark K. Cameron

(57) ABSTRACT

The invention relates to an acidic, aqueous, chromium-free composition (A) for the anti-corrosive treatment of steel and/or galvanized steel surfaces comprising metal ions (M) selected from ions at least of the elements nickel, cobalt, molybdenum, iron or tin and a multi-stage method applying the composition (A) for the anti-corrosive pre-treatment of metal components which have steel and/or galvanized steel surfaces. The invention further relates to metal surfaces of zinc or iron having a passive layer system comprising at least 30 mg/m$^2$ nickel and at least 10 mg/m$^2$ zircon, titanium and/or hafnium and sulfur, wherein nickel is present in metallic form at up to at least 30 At. %, obtainable in a method according to the invention.

24 Claims, 1 Drawing Sheet

(56) References Cited

U.S. PATENT DOCUMENTS

| | | | | |
|---|---|---|---|---|
| 6,613,387 | B2 * | 9/2003 | Agarwal et al. | 427/340 |
| 6,645,316 | B1 * | 11/2003 | Brouwer et al. | 148/253 |
| 2008/0131728 | A1 * | 6/2008 | Nadupparambil Sekharan et al. | 428/650 |
| 2008/0302448 | A1 * | 12/2008 | Frey et al. | 148/274 |
| 2009/0084682 | A1 * | 4/2009 | McMillen et al. | 205/50 |
| 2009/0255608 | A1 * | 10/2009 | Brouwer et al. | 148/241 |
| 2010/0209732 | A1 * | 8/2010 | Hackbarth et al. | 428/659 |
| 2011/0041957 | A1 * | 2/2011 | Brouwer et al. | 148/247 |

FOREIGN PATENT DOCUMENTS

| | | | |
|---|---|---|---|
| DE | 102006052919 | A1 | 5/2008 |
| FR | 2352070 | A1 | 12/1977 |
| GB | 789131 | A | 1/1958 |
| JP | 2006/322048 | * | 11/2006 |
| JP | 2006322048 | A | 11/2006 |
| WO | 9111542 | A2 | 8/1991 |
| WO | 0073536 | A1 | 12/2000 |
| WO | 2007065645 | A1 | 6/2007 |
| WO | 2008135478 | A2 | 11/2008 |
| WO | 2009045845 | A2 | 4/2009 |

OTHER PUBLICATIONS

German Examination Report issued Jun. 6, 2011 for PCT/EP2010/067448. All references cited in the German Examination Report are listed herein.

IUPAC Rule 1-5.5.2.1 ("Nomenclature of Inorganic Chemistry—Recommendations 1990", Blackwell: Oxford, 1990 Cited in the specification on p. 7, lines 21-22.

VDA 621-415, (in German) 3 pages. Cited in the specification on p. 17, line 18, Feb. 1982.

DIN EN ISO 20567-1 Paints and Varnishes—Determination of stone-chip resistance of coatings—Part 1: Multi-impact testing (ISO 20567-1:2005); German version EN ISO 20567-1:2006, 19 pages Cited in the specification on p. 17, line 19, Apr. 2007.

German Examination Report issued Jun. 6, 2011 for PCT/EP2010/067448. All references cited in the German Examination Report were cited in the Information Disclosure Statement filed with an RCE in the instant application on Jul. 26, 2013.

IUPAC Rule 1-5.5.2.1 ("Nomenclature of Inorganic Chemistry—Recommendations 1990", Blackwell: Oxford, 1990 Cited in the specification on p. 7, lines 21-22, This reference was cited in the Information Disclosure Statement filed with an RCE in the instant application on Jul. 26, 2013.

* cited by examiner

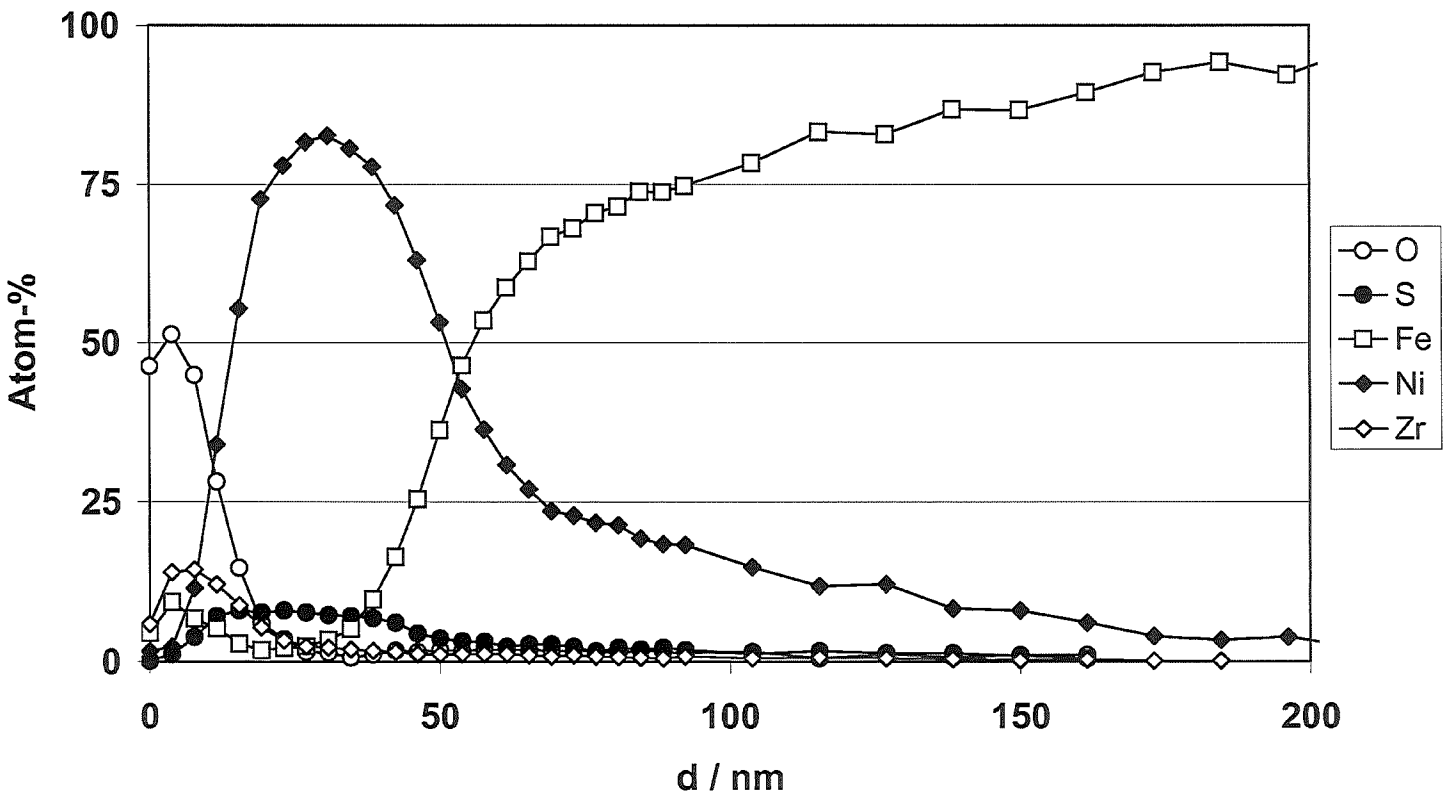
O
S
Fe
Ni
Zr
Atom-%
100
75
50
25
0
0
50
100
150
200
d / nm

MULTI-STAGE PRE-TREATMENT METHOD FOR METAL COMPONENTS HAVING ZINC AND IRON SURFACES

The present invention relates to an acidic aqueous, chromium-free composition (A) for the anti-corrosive treatment of steel and/or galvanized steel surfaces, encompassing metal ions (M) selected from ions of at least one of the elements nickel, cobalt, molybdenum, iron or tin, as well as a multi-stage method using the composition (A) for the anti-corrosive pre-treatment of metal components which have surfaces of steel and/or galvanized steel. Furthermore, the invention relates to metal surfaces of zinc or iron, which have a passive layer system containing at least 30 mg/m$^2$ nickel and at least 10 mg/m$^2$ zirconium, titanium and/or hafnium, and sulfur, nickel being present in metallic form in an amount of at least 30 at. %, obtainable in a method according to the invention.

Corrosion inhibitors which represent an acidic aqueous solution of fluoro complexes have long been known and replace the chromating methods long used in the prior art for passivating pre-treatment. Recently, corrosion inhibitors of this type, which create only a thin conversion layer on the treated metal surfaces, are also being discussed as a substitute for phosphating methods and are being used especially in the automotive supply industry to replace the multi-stage phosphating process, which is associated with high turnovers, with methods having a lower turnover and lower process complexity. These solutions of fluoro complexes generally contain other anti-corrosive active substances which further improve the anti-corrosive action and paint adhesion.

For example, WO 07/065,645 describes aqueous compositions which contain fluoro complexes of, inter alia, titanium and/or zirconium, with the additional inclusion of a further component which is selected from: nitrate ions, copper ions, silver ions, vanadium or vanadate ions, bismuth ions, magnesium ions, zinc ions, manganese ions, cobalt ions, nickel ions, tin ions, buffer systems for the pH range of 2.5 to 5.5, aromatic carboxylic acids having at least two groups which contain donor atoms, or derivatives of such carboxylic acids, silica particles having an average particle size below 1 μm.

A need exists to advance the anti-corrosive pre-treatment of metal surfaces further and to bring it closer to the performance features of trication zinc phosphating in terms of corrosion protection and paint adhesion. Here, not only is the number of individual process steps crucial for the success of a pre-treatment, but also the performance of the coating, particularly in relation to the pre-treatment of components that are composed of the materials steel, galvanized steel and aluminum.

From the published patent application WO 2009045845, an electroless metallizing pre-treatment prior to a zirconium-based conversion treatment of metal surfaces, particularly steel and galvanized steel, is known. Here, prior to conversion treatment, a pre-treatment with an acidic aqueous composition containing water-soluble salts of electropositive metals selected from nickel, copper, silver and/or gold is performed. Such a composition for metallization can additionally contain defoamers and wetting agents. When using sparingly soluble copper salts, it is proposed in WO 2009045845 to use complexing agents to increase the concentration of copper ions in the metallizing composition. It is shown that the metallizing prior to a conversion treatment proposed in WO 2009045845 does not reach the paint adhesion and corrosion resistance that can be achieved by zinc phosphating and subsequent dip coating.

The published patent application U.S. Pat. No. 5,032,236 describes electrolytic film formation on steel substrates to form black coatings using largely chromium(VI)-free electrolyte containing at least 50 g/l of zinc ions and at least 50-300 g/l of metal cations selected from cations of the elements iron, cobalt and/or nickel. In addition, the aqueous composition can contain electropositive metal cations of the elements copper, silver, tin and/or bismuth. Other components of the compositions disclosed in U.S. Pat. No. 5,032,236 for electrolytic film formation are ionogenic compounds that improve film formation. Inorganic and organic sulfur compounds, inter alia, are suitable for this purpose. According to the teaching of U.S. Pat. No. 5,032,236, such an electrolytic film formation can be followed by a chromating and then the deposition of a dipping paint to build up an anti-corrosive coating system on steel surfaces, with steel surfaces coated according to this process sequence offering good protection against corrosion with good paint adhesion values. Disadvantages of this electrolytic process are, on the one hand, the consumption of electrical energy and, on the other hand, the high concentrations of ionogenic components required for the process, which necessitate the use of bath stabilizers and bath care involving complex apparatus with regard to regeneration of its active components and disposal of unavoidable heavy metal sludges.

From U.S. Pat. No. 4,278,477, the person skilled in the art can take an alkaline aqueous composition containing metal cations selected from ions of the elements cobalt, nickel, iron and/or tin in a quantity of 0.01-1 g/l, a complexing agent selected from pyrophosphate and/or nitrilotriacetic acid to prevent precipitation of sparingly soluble heavy metal salts and, optionally, a reducing agent, preferably sulfite. These alkaline compositions, according to the teaching of U.S. Pat. No. 4,278,477, are suitable for the electroless coating of zinc surfaces, with a zinc surface coated in this way exhibiting high corrosion resistance with good paint adhesion values after chromating and application of a surface coating system. Owing to the low ionic concentrations and the presence of the complexing agent, high bath stability is ensured. However, the method disclosed in U.S. Pat. No. 4,278,477 does not allow satisfactory pre-treatment of steel surfaces and the compositions contain relatively large quantities of complexing phosphates and/or nitrilotriacetic acid, which are of concern from an ecological viewpoint.

In the prior art, therefore, no multi-stage process exists for the anti-corrosive pre-treatment of both zinc and steel surfaces which is at least equivalent to trication phosphating in terms of corrosion protection and paint adhesion properties and can be operated in a resource-saving manner.

The object of the present invention accordingly consists in establishing a method for anti-corrosive pre-treatment which is suitable for the subsequent application of organic surface coating systems, encompasses no electrolytic process steps and in which the deposition of small quantities of active components is sufficient for effective corrosion protection, without any significant quantities of these active components settling in the treatment bath by precipitation reactions resulting from the process, which may need to be reprocessed. In addition, it should be possible in a method according to the invention to provide different metal surfaces of a component, which represent surfaces of steel, galvanized steel and aluminum, with an anti-corrosive coating which is at least equivalent to trication phosphating.

This object is achieved by a multi-stage method for the anti-corrosive pre-treatment of metal components which have surfaces of steel and/or galvanized steel, encompassing the process steps i)-iii), which each involve bringing the metal component into contact with an aqueous treatment solution, wherein the respective process steps i)-iii) are as follows:

i) cleaning and degreasing the metal surface;

ii) electroless treatment by bringing the metal surface into contact with an acidic aqueous chromium-free composition (A) according to the invention;

iii) passivating treatment by bringing the metal surface into contact with an acidic aqueous composition (B) containing a) at least one water-soluble compound of the elements Zr, Ti and/or Hf in a concentration of at least 5 ppm based on the elements Zr and/or Ti, wherein the process steps ii) and iii) are always carried out after cleaning and degreasing of the metal surface, with or without an intermediate rinsing step, but in any order.

An acidic aqueous chromium-free composition (A) according to the invention which, when brought into contact with steel and/or galvanized steel in a method according to the invention, brings about effective corrosion protection by the deposition of only small quantities of active components, contains a) at least 100 ppm of metal ions (M) selected from ions of at least one of the elements nickel, cobalt, molybdenum, iron or tin, b) at least one water-soluble compound containing sulfur in an oxidation state of less than +6, c) less than 10 g/l of zinc ions, d) a total of less than 1 g/l of dissolved phosphates calculated as $PO_4$, and preferably has a pH value in the range of 3.0 to 6.5.

If metal components comprising steel and galvanized steel are treated in methods according to the invention with a composition (A) according to the invention, the surface of the metal component consisting of at least 10% of galvanized steel surfaces, the pH value is preferably in a range of 4.0 to 7.0, particularly preferably in a range of 5.0 to 7.0, in particular in the range of 6.0 to 6.8.

According to the invention, the composition (A) is chromium-free if less than 10 ppm, preferably less than 1 ppm of chromium, in particular no chromium(VI) whatsoever, is contained.

By the electroless treatment of metal surfaces after the degreasing stage and before or after the passivating treatment of the method according to the invention with a composition (A), a deposition of the metal ions (M) (active component) is brought about on the metal surfaces. This film formation takes place at least partly in the form of metallic phases of the elements nickel, cobalt, molybdenum, iron or tin.

The film-forming deposition of the metal ions (M) in the presence of the reducing water-soluble compound containing sulfur in an oxidation state of less than +6 is inhibited in the presence of zinc ions. The composition (A) according to the invention therefore contains less than 10 g/l.

The composition (A) can additionally contain, in a preferred embodiment, chelating organic compounds which have at least two functional groups with oxygen and/or nitrogen atoms selected from carboxyl, hydroxyl, amine, phosphoric acid or phosphonic acid groups. Particularly preferred are chelating organic compounds which contain phosphoric acid, phosphonic acid and/or hydroxyl groups, for example 1-hydroxyethane-(1,1-diphosphonic acid). It has been found that such chelating agents in the composition (A) according to the invention primarily complex zinc ions and therefore attenuate the inhibition of deposition of metal ions (M) on the metal surfaces. The chelating organic compounds are preferably contained in a quantity such that the relative molar excess of zinc ions to the chelating organic compounds is no greater than 2 g/l, preferably no greater than 1 g/l and particularly preferably no greater than 0.5 g/l of zinc ions.

Overall, however, those compositions (A) are preferred which have a content of zinc ions no greater than 2 g/l, preferably no greater than 1 g/l and particularly preferably no greater than 0.5 g/l of zinc ions.

The quantity of phosphate ions is also limited in the compositions (A) according to the invention, since higher proportions can cause the formation of a thin phosphate passivation, which is disadvantageous for the deposition of metal ions (M) on metal surfaces. This is surprising inasmuch as the passivating treatment of the metal surface with a composition based on zirconium, titanium and/or hafnium, as in treatment step iii) according to the invention, is not disadvantageous for the film-forming deposition of metal ions (M). Those compositions (A) according to the invention in which the proportion of dissolved phosphate is no more than 500 ppm, particularly preferably no more than 200 ppm and in particular no more than 50 ppm, calculated as $PO_4$, are therefore preferred.

The presence of water-soluble compounds of the elements zirconium, titanium and/or hafnium in a composition (A) according to the invention can inhibit the deposition of metal ions (M) on steel surfaces. In addition, no deposition of zirconium, titanium and/or hafnium results from such compositions (A), so that the use of these compounds provides no advantage and is uneconomical. Accordingly, compositions (A) according to the invention are preferred in which the proportion of zirconium, titanium and/or hafnium in the form of water-soluble compounds is in total less than 20 ppm and more preferably less than 5 ppm.

The at least one water-soluble compound containing sulfur in an oxidation state of less than +6 is preferably selected from inorganic compounds, particularly preferably from oxo acids of sulfur, such as sulfurous acid, thiosulfuric acid, dithionic acid, polythionic acid, sulfurous acid, disulfurous acid and/or dithionic acid and salts thereof and particularly preferably from sulfurous acid. The water-soluble compound containing sulfur can also be selected from salts of the organic acids thiocyanic acid and/or thiourea, the aforementioned water-soluble inorganic compounds containing sulfur being preferred to the organic acids and salts.

The oxidation state is defined in relation to the present invention according to IUPAC Rule I-5.5.2.1 ("Nomenclature of Inorganic Chemistry—Recommendations 1990", Blackwell: Oxford, 1990) and refers to the hypothetical charge that would be allocated to an element in a molecule if this element were allocated all the electrons shared with other elements of the molecule for which the element has a higher electronegativity than that of the element with which it shares the electrons.

The preferred concentration of water-soluble compounds containing sulfur in an oxidation state of less than +6 is at least 1 mM, preferably at least 5 mM, but no more than 100 mM, preferably no more than 50 mM. Below 1 mM, a film-forming deposition of the metal ions (M) does not exist or does not occur in typical treatment times of a few minutes. Above 100 mM, on the one hand no further acceleration of the film formation is observed when a cleaned steel surface is brought into contact with such a composition (A) and, on the other hand, larger quantities of sulfur-containing compounds should be rejected for economic and health and safety reasons.

Other reducing agents based on water-soluble compounds containing phosphorus and/or nitrogen in an oxidation state of less than +5 surprisingly prove unsuitable for the deposition of metal ions (M), in particular for the deposition of nickel and/or cobalt ions, and so for economic reasons these reducing agents are preferably not contained in the composition (A) or are contained only in very small quantities below 50 ppm.

In compositions (A) according to the invention, preferably at least 0.2 g/l but no more than 5 g/l, preferably no more than 2 g/l of metal ions (M) selected from ions of at least one of the elements nickel, cobalt, molybdenum, iron or tin are contained. If the value is below this level, the activity of the metal ions (M) in the composition (A) is usually too low for adequate deposition. Above 5 g/l there is no additional advantage, whereas the precipitation of insoluble salts of metal ions (M) increases, so that such high concentrations of metal ions (M) in treatment baths in accordance with step ii) of the method according to the invention are uneconomical and also require increased processing costs.

As the metal ions (M) that are deposited on the metal surfaces in process step ii) from the acidic aqueous composition (A), in a preferred embodiment, in particular nickel and/or cobalt, particularly preferably nickel, are suitable. Metal surfaces of steel and/or galvanized steel, which, irrespective of the sequence of process steps ii) and iii), are brought into contact with an aqueous composition (A) containing nickel and/or cobalt ions, particularly preferably nickel ions, are provided within a short treatment time with a thin layer containing the elements nickel and/or cobalt, which gives excellent adhesion to subsequently applied organic surface coating systems while meeting the highest requirements for corrosion protection.

Preferred water-soluble compounds that release metal ions (M) are all water-soluble salts which do not contain any chloride ions. Particularly preferred are sulfates, nitrates and acetates.

A preferred composition (A) according to the invention has a molar ratio of metal ions (M) selected from ions of at least one of the elements nickel, cobalt, molybdenum, iron or tin to water-soluble compounds containing sulfur of no more than 1:1, preferably no more than 2:3, but no less than 1:5. Above this preferred molar ratio of 1:1, the formation of the thin layer containing the elements of the metal ions (M) runs more slowly, so that in particular for the application of the composition (A) in process step ii) of a coil-coating method according to the invention, those compositions (A) are preferred in which, relative to the total quantity of metal ions (M), a sufficient quantity of water-soluble compounds containing sulfur is present. Conversely, a molar ratio of metal ions (M) to water-soluble compounds containing sulfur of below 1:5 can be disadvantageous for the stability of compositions (A) according to the invention since the reducing sulfur compounds can then bring about a precipitation of the metals contained in colloidal form.

For compositions (A) according to the invention, an addition of electropositive metal cations can be advantageous to accelerate film formation. A preferred embodiment of the invention therefore additionally contains copper ions and/or silver ions, preferably copper ions, in a quantity of at least 1 ppm but no more than 100 ppm. Above 100 ppm, the deposition of the electropositive metal in elemental form on the steel and/or galvanized steel surfaces can dominate to the extent that the film formation based on the metal ions (M) is reduced so far that the paint adhesion to organic surface coatings subsequently applied in the method according to the invention is significantly impaired or inhomogeneous coatings are produced after step ii) of the method according to the invention, offering poorer protection against corrosion.

Preferred water-soluble compounds that release copper ions are all water-soluble copper salts that do not contain any chloride ions, as well as all water-soluble silver salts. Particularly preferred are sulfates, nitrates and acetates.

Likewise, the addition of water-soluble compounds which are a source of fluoride ions to a composition (A) according to the invention can be preferred, wherein the concentration of total fluoride in the composition (A) is preferably at least 50 ppm, but no greater than 2000 ppm. The addition of fluoride is particularly advantageous when, in a method according to the invention, step ii) immediately follows the cleaning step i), with or without an intermediate rinsing step, and in particular when hot-dip galvanized steel surfaces are being treated. In such a case, the pickling rate increases on the metal surfaces and more rapid deposition kinetics of the thin coating consisting of elements of the metal ions (M) and a more homogeneous coating of the metal surface are the direct consequence. Below a total quantity of 50 ppm fluoride, this additional positive effect is not well developed, while above 2000 ppm no further increase in deposition kinetics occurs, but the precipitation of insoluble fluorides becomes disadvantageous. Preferred water-soluble compounds that serve as a source of fluoride ions are hydrogen fluoride, alkali metal fluorides, ammonium fluoride and/or ammonium bifluoride.

In the method according to the invention encompassing the individual steps i-iii), a cleaning and degreasing of the metal surface is necessary for a homogeneous formation of the passivating coating according to process steps ii) and iii). In particular, those cleaning steps i) which are carried out by means of an aqueous cleaning solution are preferred according to the invention, wherein the cleaning causes a stripping of at least 0.4 $g/m^2$, but no more than 0.8 $g/m^2$ zinc, based on a surface of electrolytically galvanized steel. The person skilled in the art knows cleaners that have a corresponding stripping for a given cleaning period. It seems surprising that such a preferred cleaning leads to better results in terms of corrosion protection and paint adhesion of the steel and/or galvanized steel surfaces treated according to the invention.

The acidic aqueous compositions (B) used in step iii) of the method according to the invention are preferably chromium-free, i.e. they contain less than 10 ppm, preferably less than 1 ppm of chromium and in particular no chromium(VI). Moreover, the acidic compositions (B) in the method according to the invention preferably contain a total of 20 to 1000 ppm of water-soluble compounds of the elements zirconium, titanium and/or hafnium, based on the elements zirconium, titanium and/or hafnium. If less than 20 ppm, based on the elements zirconium, titanium and/or hafnium, is contained, an insufficient conversion of the metal surface that has been cleaned or treated in step ii) can be the consequence, so that only small quantities of hydroxides and/or oxides of these elements are deposited and the resulting passivating effect is too small. Above 1000 ppm based on the elements zirconium, titanium and/or hafnium in the composition (B), however, no further improvement of the corrosion properties of the metal surfaces treated according to the invention can be observed.

Also preferred in the method according to the invention are those acidic aqueous compositions (B) which, as water-soluble compounds of the elements zirconium, titanium and/or hafnium, only contain water-soluble compounds of the elements zirconium and/or titanium and particularly preferably water-soluble compounds of the element zirconium.

Preferred water-soluble compounds of the elements zirconium, titanium and/or hafnium are compounds which dissociate in aqueous solution into anions of fluoro complexes of the elements zirconium, titanium and/or hafnium. Preferred compounds of this type are, for example, $H_2ZrF_6$, $K_2ZrF_6$, $Na_2ZrF_6$ and $(NH_4)_2ZrF_6$ and the analogous titanium compounds. Also, fluorine-free compounds of the elements zirconium, titanium and/or hafnium can be used as water-soluble compounds according to the invention, for example, $(NH_4)_2Zr(OH)_2(CO_3)_2$ or $TiO(SO_4)$.

In addition, a composition (B) in step iii) of the method according to the invention can contain 1 to 100 ppm of copper ions and optionally up to 200 ppm of free fluoride. The addition of copper ions accelerates the conversion of the metal surfaces that have been cleaned or treated in step ii) and additionally increases the passivating effect. In particular, in the event that the passivating treatment of the steel and/or galvanized steel surfaces takes place first, a significant improvement of the film formation in the subsequent step ii), and thus improved corrosion protection properties, can be observed. Preferred water-soluble compounds which release copper ions are all water-soluble copper salts which do not contain any chloride ions. Particularly preferred are sulfates, nitrates and acetates.

The optional addition of fluoride ions in the preferred quantitative range based on free fluoride, which can in turn be determined by means of an ion-sensitive measuring electrode, facilitates the homogeneous conversion of the metal surfaces that have been cleaned or treated in step ii). Preferred water-soluble compounds that serve as a source of fluoride ions are hydrogen fluoride, alkali metal fluorides, ammonium fluoride and/or ammonium bifluoride.

The treatment temperature and the duration of the respective treatment are different in the individual steps i-iii) of the method according to the invention and are highly dependent on the bath equipment and the type of application, but can be varied over a wide range without losses having to be accepted with respect to the corrosion properties. Preferably, the treatment in steps i-iii) should be carried out as follows:

Process step i): 2-10 minutes at 30-70° C.

Process step ii): 10-300 seconds at 20-50° C.

Process step iii): 0.5-10 minutes at 20-50° C.

The specific conditions for bringing the metal surfaces into contact with the aqueous treatment stages ii) and iii) should preferably be selected such that, in step ii), a coating weight of at least 30 mg/m$^2$, particularly preferably at least 50 mg/m$^2$ of one or more of the metal ions (M) results on the surfaces of zinc, while temperature and duration of treatment in step iii) should be adapted so that a coating weight of at least 10 mg/m$^2$ zirconium and/or titanium, particularly preferably of at least 25 mg/m$^2$ zirconium and/or titanium, results on the surfaces of zinc. Below these preferred coating weights, the anti-corrosive properties of the pre-treatment are mostly inadequate.

The individual steps i-iii) of the method according to the invention can be performed with or without an intermediate rinsing step. Preferably, however, after the cleaning step i) at least one additional rinsing step takes place using tap water or deionized water ($\kappa<1$ $\mu Scm^{-1}$).

Surprisingly, exceptionally good results in terms of anti-corrosive properties and paint adhesion can be achieved irrespective of the order of steps ii) and iii) in the method according to the invention. In one preferred embodiment, however, the electroless treatment according to step ii) takes place immediately, i.e. with or without an intermediate rinsing step, after the cleaning step i). For this preferred procedure, the film formation is first completed on the basis of the elements of metal ions (M) and then a conversion of the metal surface thus treated is carried out with the aid of the zirconium- and/or titanium-containing composition (B).

The method according to the invention is suitable for metal components which have iron, steel and/or galvanized steel surfaces and the corresponding pre-phosphated surfaces. On these surfaces, irrespective of the order of steps ii) and iii), sufficient film formation based on the elements of metal ions (M) always takes place in the method according to the invention, which in turn is a prerequisite for the excellent properties in terms of corrosion and paint adhesion. Likewise, in the method according to the invention, surfaces of aluminum are also passivated in step iii), so that the method is especially suitable for the anti-corrosive pre-treatment of surfaces composed of a multi-metal construction, for example bodies in the automotive industry.

The aqueous compositions can be brought into contact with the metal surfaces in steps i-iii) by both dipping and spraying methods. The method can also be used in the pre-treatment of metal strip and there, for example, also by means of the roll coating methods known to the person skilled in the art.

The method according to the invention is usually followed by the application of a surface coating system, so that after passing through process steps i-iii), with or without an intermediate rinsing and/or drying step, preferably a dip coating or a powder coating, particularly preferably a dip coating, in particular a cathodic dip coating follows.

The present invention further encompasses a metal surface of iron and/or steel with a passive layer system containing at least 30 mg/m$^2$ nickel and at least 10 mg/m$^2$ zirconium, titanium and/or hafnium, preferably at least 10 mg/m$^2$ zirconium, and sulfur, nickel being present in metallic form in an amount of at least 30 at. %, obtainable by a preferred method according to the invention, in which process step i), with or without an intermediate rinsing step, is immediately followed by the electroless treatment according to step ii), wherein the composition (A) according to the invention in step ii) comprises at least 100 ppm but no more than 5 g/l of nickel ions and at least 1 mM sulfurous acid and/or salt thereof and the iron and/or steel surface is brought into contact with such a composition (A) at a treatment temperature in the range of 20 to 50° C. for at least one minute.

Furthermore, the present invention encompasses a metal surface of zinc and/or galvanized steel with a passive layer system containing at least 30 mg/m$^2$ nickel and at least 10 mg/m$^2$ zirconium, titanium and/or hafnium, preferably at least 10 mg/m$^2$ zirconium, and sulfur, nickel being present in metallic form in an amount of at least 30 at. %, obtainable by a method according to the invention, wherein process step ii), with or without an intermediate rinsing step, immediately follows process step iii) and wherein the composition (A) according to the invention in process step ii) encompasses at least 100 ppm but no more than 5 g/l of nickel ions and at least 1 mM sulfurous acid and/or salt thereof and the zinc and/or galvanized steel surface is brought into contact with such a composition (A) at a treatment temperature in the range of 20 to 50° C. for at least one minute.

The invention also relates to the use of the metal components treated according to the invention or of the metal strip treated according to the invention in the manufacture of automobile bodies.

EXAMPLES

Below, the anti-corrosive effect of the pre-treatment according to the invention is illustrated for different materials by means of a preferred composition (A) according to the invention.

The preferred composition (A) according to the invention has a pH value of 3.7 and the following composition (Examples E1 and E2):

3.1 g/l nickel nitrate solution, 3.8 g/l sodium hydrogen sulfite

The preferred method according to the invention (E1 and E2), according to which metal sheets of steel (CRS), hot-dip galvanized steel (HDG) and electrogalvanized steel (ZE) are treated, is characterized by the following individual steps i-iii):

i) cleaning and degreasing at 55° C. for 5 minutes with an alkaline cleaner of the composition:
   E1: 3.0 wt. % Ridoline® 1565 A; 0.4 wt. % Ridosol® 1270 (Henkel),
   E2: 3.0 wt. % Ridoline® 1574 A, 0.4 wt. % Ridosol® 1270 (Henkel)
   The cleaning solution is prepared using tap water in each case.
   A cleaning and degreasing with a cleaning solution as in Example E2 results in a stripping of 0.5 g/m$^2$ on electrogalvanized substrates, while a cleaning solution according to Example E1 does not pickle zinc surfaces.
ii) electroless treatment with the above-mentioned preferred composition (A) at 30° C. for one minute
iii) passivating treatment with a zirconium-based pre-treatment solution adjusted to a pH value of 4.0 and comprising 150 ppm zirconium, 20 ppm Cu and a free fluoride content of 60 ppm at 30° C. for two minutes (TecTalis® 1800; 0.25 g/l Grano Toner® 38, Henkel)

After each of the individual steps i-iii), a rinsing step with deionized water follows ($\kappa$<1 $\mu$Scm$^{-1}$).

For comparison purposes, after cleaning and degreasing as in the above-mentioned step i), corresponding metal sheets were provided with a conventional trication phosphating (Granodine® 952, Henkel, coating weight on 2.0 HDG/EG CRS: 2.5 g/m$^2$ determined by differential weighing after removal of the phosphate layer in aqueous 0.5 wt. % $CrO_3$ at 20° C. for 15 min) (Comparative Examples C1 and C2) or passivated with a zirconium-based conversion treatment as in the above-mentioned step iii) (Comparative Examples C3 and C4).

The metal sheets treated according to the invention and the comparison sheets were dried with compressed air after the final rinse step and electrophoretically coated with the following cathodic dip coating: Aqua® 3000 (Dupont; CDC film thickness: 20 μm determined non-destructively using a commercial film thickness measuring instrument)
and the paint is then baked in an oven at 175° C. for 25 min.

The metal sheets were then subjected to a corrosion test under changing climatic conditions according to VDA 621.415 (10 cycles) or a stone impact test according to DIN EN ISO 20567-1. The resulting test results are summarized in Table 1.

Overall, it is shown in Table 1 that the metal sheets treated according to the invention (E1 and E2) are clearly superior to those that have undergone only a zirconium-based conversion treatment (C3 and C4), both in terms of creep corrosion of the coating (U/2 values) and in the stone impact test (K values).

In addition, the corrosion results show that an anti-corrosive coating at least equivalent to trication zinc phosphating (C1 and C2) is achieved with the method according to the invention.

Overall, especially on galvanized surfaces that are treated in a method according to the invention (E1 and E2), a significant improvement in corrosion properties and an increase in paint adhesion to the CDC are achieved, which are significantly improved even in comparison to trication zinc phosphating.

Surprisingly, it is shown that the cleaning of zinc surfaces with a pickling cleaning solution brings about another significant performance improvement of the zinc surfaces treated according to the invention and coated with the dip coating (E2 vs. E1) in the stone impact test. Such an improvement on zinc surfaces by the pickling action of the cleaner occurs only in the method according to the invention and is absent both in the exclusively zirconium-based conversion treatment (C4 vs. C3) and the exclusively trication zinc phosphating (C2 vs. C1).

TABLE 1

Creep corrosion values and stone impact test

| | U/2 in mm | | | K value | | |
|---|---|---|---|---|---|---|
| | CRS | HDG | ZE | CRS | HDG | ZE |
| E1 | 0.8 | 2.3 | 1.3 | 5.0 | 6.0 | 4.0 |
| E2 | 0.8 | 1.8 | 1.0 | 5.0 | 2.5 | 2.0 |
| C1 | 1.0 | 2.5 | 2.9 | 4.5 | 6.0 | 6.0 |
| C2 | 0.7 | 3.0 | 3.2 | 4.0 | 6.0 | 6.0 |
| C3 | 1.3 | 4.2 | 3.2 | 7.0 | 9.0 | 8.5 |
| C4 | 1.6 | 4.0 | 3.8 | 5.0 | 8.0 | 10.0 |

The intolerance of the method according to the invention towards an excessive quantity of zinc and/or phosphate ions is illustrated in Tables 2 and 3.

It is shown that the inhibition of the deposition of nickel in process step ii) by zinc ions proceeds largely independently of the substrate, the method according to the invention still providing sufficiently good corrosion protection values when the coating weight is at least 30 mg/m$^2$, based on the element nickel.

TABLE 2

Nickel coating weight in mg/m$^2$ as a function of the concentration of zinc ions in a method according to the invention analogous to Example E1 with varying pH value

| | | Quantity of zinc in g/l | | | | | |
|---|---|---|---|---|---|---|---|
| Substrate | pH | 0 | 0.2 | 0.3 | 0.5 | 1.0 | 2.0 |
| HDG | 3.7 | 172 | 104 | 68 | 31 | 6 | 0 |
| | 5.0 | 311 | 154 | 142 | 106 | 35 | 12 |
| CRS | 5.0 | 353 | 202 | 142 | 112 | 42 | 15 |

The nickel coating weight was determined by X-ray fluorescence analysis after individual step iii)

There is a tendency at higher pH values, on both zinc and steel sheets, for a larger quantity of nickel to be deposited in the method according to the invention analogous to Example E1, so that tolerance to zinc ions can be increased in this way.

The inhibition of nickel deposition by phosphate ions in process step ii), however, is much more pronounced on zinc surfaces than on steel (Table 3). While at a pH value of composition (A) of 3.7 in process step ii) 65 mg/m$^2$ Ni are deposited on the steel sheets at a phosphate content of 0.25 g/l, which is an adequate quantity for good corrosion protection, no nickel whatsoever is deposited on zinc sheets under identical conditions. Raising the bath temperature in process step ii) to 40° C. in turn causes an increased deposition of nickel, so that on zinc sheets a coating weight of 92 mg/m$^2$ nickel is measured.

TABLE 3

Nickel coating weight in mg/m$^2$ as a function of the concentration of phosphate ions in a method according to the invention analogous to Example E1

| | | Quantity of phosphate in g/l | | | | |
|---|---|---|---|---|---|---|
| Substrate | pH | 0 | 0.025 | 0.05 | 0.1 | 0.25 |
| HDG | 3.7 | 398 | 148 | 72 | 15 | 0 |
| CRS | 3.7 | 277 | 248 | 184 | 155 | 65 |

The nickel coating weight was determined by X-ray fluorescence analysis after individual step iii)

FIG. 1 shows an XPS sputter profile (XPS=X-ray photoelectron spectroscopy) of a coating on steel sheet (CRS), which was treated according to example E1. This depth profile shows, on the one hand, that the treatment of steel in the method according to the invention produces coatings which, in addition to nickel, also contain sulfur, and, on the other hand, that the conversion treatment in step iii) produces a surface zirconium oxide layer on the nickel-containing coating.

What is claimed is:

1. An acidic aqueous chromium-free composition (A) comprising a) at least 100 ppm to 5 g/l of metal ions (M) selected from the group consisting of ions of at least one of the elements nickel, cobalt, molybdenum, iron and tin, b) 1 mM to 100 mM/l of at least one water-soluble inorganic compound containing sulfur in an oxidation state of less than +6, c) less than 10 g/l of zinc ions, d) a total of 0.025 g/l to less than 1 g/l of dissolved phosphates, calculated as $PO_4$;

wherein the acidic aqueous chromium-free composition (A) has a pH value in a range of 3.0 to 6.5.

2. The composition according to claim 1, wherein a) is present in an amount of at least 0.2 g/l, but no more than 2 g/l.

3. The composition according to claim 1, wherein a molar ratio of metal ions (M) to water-soluble compounds containing sulfur in the composition (A) is no greater than 1:1, but no less than 1:5.

4. The composition according claim 1, wherein the water-soluble compound containing sulfur is selected from the group consisting of water-soluble oxoacids of sulfur and salts thereof.

5. An acidic aqueous chromium-free composition (A) comprising a) at least 100 ppm to 5 g/I of metal ions (M) selected from the group consisting of ions of at least one of the elements nickel, cobalt, molybdenum, iron and tin, b) 1mM to 100 mM/I of at least one water-soluble compound containing sulfur in an oxidation state of less than +6, c) less than 10 g/I of zinc ions, d) a total of 0.025 g/I to less than 1 g/I of dissolved phosphates, calculated as $PO_4$;

wherein the acidic aqueous chromium-free composition (A) has a pH value in a range of 3.0 to 6.5; and wherein the water soluble compound containing sulfur comprises at least one of sulfurous acid, sulfurous acid salts, salts of thiocyanic or from thiourea.

6. The composition according claim 1, further comprising copper ions and/or silver ions, in a quantity of at least 1 ppm but no more than 100 ppm.

7. The composition according to claim 1, further comprising water-soluble compounds that represent a source of fluoride ions wherein concentration of total fluoride in the composition (A) is at least 50 ppm but no more than 2000 ppm.

8. The composition according to claim 1, further comprising 5 mM to 50 mM of chelating organic compounds containing at least two functional groups with oxygen and/or nitrogen atoms selected from the group consisting of carboxyl, hydroxyl, amine, phosphoric acid and phosphonic acid groups.

9. The composition according to claim 8, wherein the chelating organic compounds are contained in a quantity such that a molar excess of zinc ions based on the chelating organic compounds is no greater than 2 g/l.

10. A multi-stage method for the anti-corrosive pre-treatment of metal components which have metal surfaces of steel and/or galvanized steel, comprising the process steps i)-iii), which each involve bringing the metal component into contact with an aqueous treatment solution, wherein the consecutive process steps i)-iii), with or without an intermediate rinsing step in each case, are as follows:

i) cleaning and degreasing the metal surface;

ii) electroless treatment by bringing the metal surface into contact with an acidic aqueous chromium-free composition (A) comprising:

a) at least 100 ppm to 5 g/l of metal ions (M) selected from the group consisting of ions of at least one of the elements nickel, cobalt, molybdenum, iron and tin, b) 1mM to 100 mM/I of at least one water-soluble compound containing sulfur in an oxidation state of less than +6, c) less than 10 g/l of zinc ions, d) a total of 0.025 q/l to less than 1 g/l of dissolved phosphates, calculated as $PO_4$;

wherein the acidic aqueous chromium-free composition (A) has a pH value in a range of 3.0 to 6.5;

iii) passivating treatment by bringing the metal surface into contact with an acidic aqueous composition (B) containing at least one water-soluble compound of at least one of the elements Zr, Ti and/or Hf in a concentration of at least 5 ppm based on the elements Zr and/or Ti.

11. A metal surface comprising iron and deposited on the metal surface a passive layer system which contains at least 30 mg/m$^2$ Ni, and at least 10 mg/m$^2$ zirconium, titanium and/or hafnium; and sulfur; the Ni being present in metallic form in an amount of at least 30 at. %.

12. An acidic aqueous chromium-free composition (A) comprising a) at least 100 ppm of metal ions (M) selected from the group consisting of ions of at least one of the elements nickel, cobalt, molybdenum, iron and tin, b) at least one water-soluble compound containing sulfur in an oxidation state of less than +6, c) less than 10 g/l of zinc ions, d) a total of less than 1 g/l of dissolved phosphates, calculated as $PO_4$;

and one or both of:

e) copper ions and/or silver ions, in a quantity of at least 1 ppm but no more than 100 ppm; and f) water-soluble compounds that provide a source of fluoride ions wherein concentration of total fluoride in the composition (A) is at least 50 ppm but no more than 2000 ppm.

13. An acidic aqueous chromium-free composition (A) comprising a) at least 100 ppm to 5 g/l of metal ions (M) selected from the group consisting of ions of at least one of the elements nickel, cobalt, molybdenum, iron and tin, b) 1mM to 100 mM/l of at least one water-soluble compound containing sulfur in an oxidation state of less than +6, c) less than 10 g/l of zinc ions, d) a total of 0.025 g/l to less than 1 g/l of dissolved phosphates, calculated as $PO_4$; and further comprising 5 mM to 50 mM of chelating organic compounds containing at least two functional groups with oxygen and/or nitrogen atoms selected from the group consisting of carboxyl, hydroxyl, amine, phosphoric acid and phosphonic acid groups, wherein the acidic aqueous chromium-free composition (A) has a pH value in a range of 3.0 to 6.5.

14. The composition according claim 1, further comprising water- soluble salts of thiocyanic acid and/or thiourea.

15. The composition according claim 5, wherein the water-soluble compound containing sulfur comprises inorganic sulfur compounds.

16. The composition according claim 10, wherein the water-soluble compound containing sulfur comprises inorganic sulfur compounds.

17. The composition according claim 12, wherein the water-soluble compound containing sulfur comprises inorganic sulfur compounds.

18. The composition according claim 13, wherein the water-soluble compound containing sulfur comprises inorganic sulfur compounds.

19. The composition according claim 5, further comprising copper ions and/or silver ions, in a quantity of at least 1 ppm but no more than 100 ppm.

20. The composition according claim 5, further comprising water-soluble compounds that represent a source of fluoride ions wherein concentration of total fluoride in the composition (A) is at least 50 ppm but no more than 2000 ppm.

21. The composition according claim 5, further comprising 5 mM to 50 mM of chelating organic compounds containing at least two functional groups with oxygen and/or nitrogen atoms selected from the group consisting of carboxyl, hydroxyl, amine, phosphoric acid and phosphonic acid groups, wherein the chelating organic compounds are contained in a quantity such that a molar excess of zinc ions based on the chelating organic compounds is no greater than 2 g/l.

22. The composition according claim 10, further comprising copper ions and/or silver ions, in a quantity of at least 1 ppm but no more than 100 ppm.

23. The composition according claim 22, further comprising water-soluble compounds that represent a source of fluoride ions wherein concentration of total fluoride in the composition (A) is at least 50 ppm but no more than 2000 ppm.

24. The composition according claim 12, further comprising 5 mM to 50 mM of chelating organic compounds containing at least two functional groups with oxygen and/or nitrogen atoms selected from the group consisting of carboxyl, hydroxyl, amine, phosphoric acid and phosphonic acid groups, wherein the chelating organic compounds are contained in a quantity such that a molar excess of zinc ions based on the chelating organic compounds is no greater than 2 g/l.

* * * * *

UNITED STATES PATENT AND TRADEMARK OFFICE

CERTIFICATE OF CORRECTION

PATENT NO. : 8,715,403 B2
APPLICATION NO. : 13/484848
DATED : May 6, 2014
INVENTOR(S) : Jan-Willem Brouwer et al.

It is certified that error appears in the above-identified patent and that said Letters Patent is hereby corrected as shown below:

On the title page, item 57, ABSTRACT, line 32: Change "At%" to -- at% --.

In the claims

Column 12, line 32: Change "q/l" to -- g/l --.

Signed and Sealed this
Twenty-sixth Day of July, 2016

Michelle K. Lee

Michelle K. Lee
*Director of the United States Patent and Trademark Office*